US007417526B2

(12) United States Patent
Hell

(10) Patent No.: US 7,417,526 B2
(45) Date of Patent: Aug. 26, 2008

(54) SELF-CONFIGURING COMPONENT BY MEANS OF ARCING

(75) Inventor: Stephan Hell, Duisburg (DE)

(73) Assignee: Wickmann-Werke GmbH, Witten (DE)

( * ) Notice: Subject to any disclaimer, the term of this patent is extended or adjusted under 35 U.S.C. 154(b) by 364 days.

(21) Appl. No.: 10/529,468

(22) PCT Filed: Aug. 27, 2003

(86) PCT No.: PCT/EP03/09458

§ 371 (c)(1),
(2), (4) Date: Jan. 19, 2006

(87) PCT Pub. No.: WO2004/034416

PCT Pub. Date: Apr. 22, 2004

(65) Prior Publication Data

US 2006/0138588 A1 Jun. 29, 2006

(30) Foreign Application Priority Data

Sep. 28, 2002 (DE) ..... 102 45 393

(51) Int. Cl.
*H01H 85/04* (2006.01)

(52) U.S. Cl. ..... 337/297; 337/161; 337/183

(58) Field of Classification Search ..... 337/297, 337/161, 183, 295
See application file for complete search history.

(56) References Cited

U.S. PATENT DOCUMENTS 2,989,739 A * 6/1961 Wilson ..... 340/638
3,614,345 A * 10/1971 Quinn ..... 200/2
3,931,602 A * 1/1976 Plasko ..... 337/163
4,814,853 A * 3/1989 Uchida ..... 257/530
4,870,386 A * 9/1989 Arikawa ..... 337/162
5,444,287 A * 8/1995 Bezama et al. ..... 257/467
5,963,122 A * 10/1999 Endo et al. ..... 337/198
6,144,283 A * 11/2000 Matsumura ..... 337/198
6,300,859 B1 * 10/2001 Myong et al. ..... 337/182
6,452,475 B1 * 9/2002 Kawazu et al. ..... 337/290
6,836,206 B2 * 12/2004 Lee ..... 337/243
7,265,653 B2 * 9/2007 Rupalla et al. ..... 337/185

FOREIGN PATENT DOCUMENTS

| | | | |
|---|---|---|---|
| DE | 813 563 B | | 9/1951 |
| DE | 3221919 A1 | * | 12/1983 |
| DE | 37 23 832 C2 | | 5/1989 |
| DE | 690 21 493 T2 | | 2/1996 |
| DE | 19957423 A1 | * | 11/2000 |
| EP | 0 423 897 A1 | | 4/1991 |
| GB | 23 20 984 A | | 7/1998 |

* cited by examiner

*Primary Examiner*—Anatoly Vortman
(74) *Attorney, Agent, or Firm*—Bell, Boyd & Lloyd LLP

(57) ABSTRACT

A component with an internal conductor is so configured that it is ruptured at a predetermined position while forming an arc, if predetermined current/voltage conditions occur at the terminals of the component. The component includes a circuit element which is so arranged that an arc formed at the predetermined position can act on the circuit element such that the circuit element alters its electrical properties.

19 Claims, 1 Drawing Sheet

SELF-CONFIGURING COMPONENT BY MEANS OF ARCING

BACKGROUND OF THE INVENTION

The invention relates to a component with an internal conductor, which is so configured that it is ruptured at a predetermined position whilst forming an arc if predetermined current/voltage conditions occur at terminals of the component.

A component of the type referred to above is, for instance, a fuse component embodied as a chip fuse. When the current flow through the chip fuse exceeds a maximum value for a predetermined period of time, the fuse can blow, i.e. a fusible conductor can rupture. Beginning at the rupture point, an arc forms in the fuse component, which enables a continued flow of current between the terminals of the chip fuse, notwithstanding the ruptured fusible conductor. The arc and the thus continuing current flow are undesired. Particularly in the event of a short circuit, with very high currents transported via the arc, undesired damage of the fuse element and the surrounding circuit can occur. At least a limitation of the current flowing via the arc on rupturing in the event of a short circuit is therefore desirable. Such a current limitation could be produced, for instance, by a resistance connected in series with the fuse component. Such a series resistance would, however, be disruptive in normal operation with the fuse intact because as small as possible a resistance of the fuse component is desired.

It is thus the object of the invention to provide a component with which a fuse component may be produced, in which a reduced current flow is possible in the event of rupturing without having a negative effect on the operating parameters in normal operation (before rupturing).

BRIEF SUMMARY OF THE INVENTION

This object is solved in a component in a type referred to above if a circuit element is so arranged in the component that an arc produced at the predetermined position can act on the circuit element so that the circuit element alters its electrical properties.

The core concept of the invention is to make use of the energy liberated by the arc when rupturing occurs so that the electrical properties of a circuit element of a component are altered by it in a desired manner, that is to say the component is reconfigured. In the simplest case, the component is a two-pole component having two terminals, whereby the change in the electrical properties of the circuit element caused by the arc results in an altered two-pole behaviour of the component. In an alternative embodiment (which is not discussed in detail below) the internal conductor, ruptured by the arc, and the circuit element, whose electrical properties are altered, are connected to separate terminals of the component.

In a preferred embodiment, the component is a layered component, in which the conductor and the circuit element are constituted by structured layers on a substrate. Theses are, for instance, thick-film conductive layers and thick-film resistive layers.

The circuit element, which is reconfigured by the arc, can, for instance, be any two-pole component. In one embodiment, this two-pole component alters its electrical resistance under the action of the arc; the resistance is preferably increased. In a further preferred embodiment, the circuit element is a second conductor, which is ruptured under the action of the arc. In this embodiment, the internal conductor is so to speak firstly ruptured whilst forming the arc and, as a consequence of this arc, the second conductor also ruptures. In order to make an energetically favourable action of the arc on the second conductor possible, the second conductor preferably crosses over the internal conductor at the predetermined position, at which the internal conductor is ruptured whilst forming the arc.

A preferred embodiment of the component is characterised in that a resistive element is connected in the component in parallel with the second conductor, on which the arc can act. The parallel circuit thus formed has a very low resistance before the action of the arc and after the action of the arc has only the resistance of the resistive element. This parallel circuit comprising the circuit element and resistive element is preferably connected in series to the internal conductor, which is ruptured to form the arc. This series circuit has, before the formation of an arc, a very low resistance, namely that of the series circuit of the internal conductor and the second conductor. Under predetermined current/voltage conditions at the terminals of the component, for instance when a relatively high current flows, the internal conductor is ruptured and the arc forms. The second conductor is also ruptured. The resistive element is consequently connected in series with the arc, which is still present, of the internal conductor. The resistive element then limits the current flow via the arc.

The last mentioned embodiment is preferably used in the form of a fuse element, whereby the internal conductor is ruptured to form an arc if a current through the conductor exceeds a maximum value for an associated maximum period of time. "Blowing" (rupture) can occur at different currents, at higher currents a lower current flow duration is required for blowing. Such a fuse element has the advantage that in the event of blowing occurring and an arc being produced, a resistance is switched into the current path. The resistance, i.e. the resistive element, must be so designed, having regard to the power loss, that the short circuit current is limited to a fraction, which results in a substantially lower stressing of the component and the surrounding circuit.

In a preferred embodiment, the resistive element connected in parallel with the second conductor has a resistance between 5Ω and 20Ω. The dimensioning of the resistive element, both as regards the ohmic resistance and also its maximum power loss, depends on the application of the fuse element, particularly on the blowing current and the maximum applied voltage.

In a preferred embodiment of the fuse element, the internal and the second conductors and the resistive element are constituted by structured layers on a substrate, the internal conductor being arranged above a section of the second conductor and being separated from it by an electrically insulating layer. For instance, the internal conductor crosses over the second conductor covered by an insulating layer.

Advantageous and preferred embodiments of the invention are characterised in the dependent claims.

BRIEF DESCRIPTION OF THE DRAWINGS

The invention will be described in more detail below with reference to a preferred exemplary embodiment illustrated in the drawings, in which.

DETAILED DESCRIPTION OF THE INVENTION

Figure 1A:
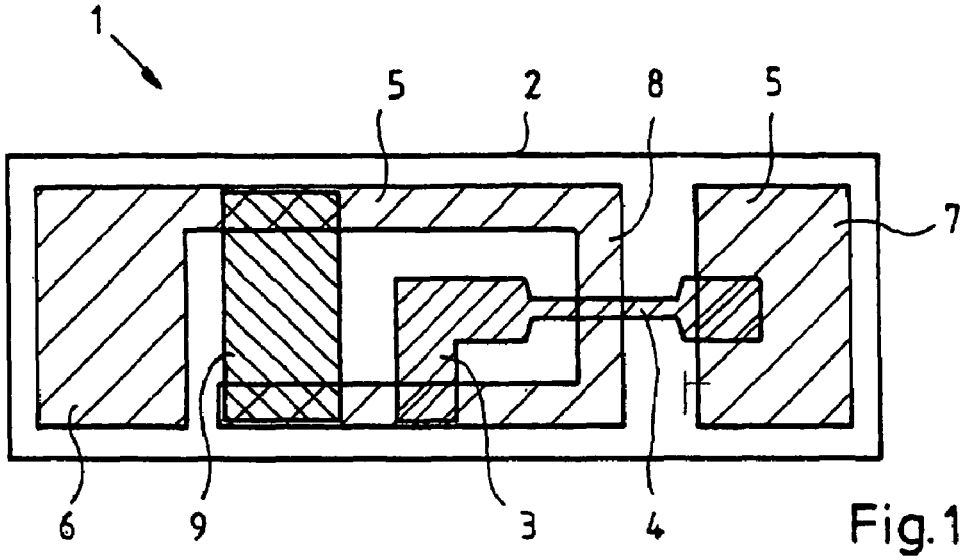
FIG. 1A is a schematic view of the important elements of the layout of a fuse component in accordance with the invention in normal operation.

FIG. 1A is a schematic plan view of the upper surface of a component 1. Applied to the upper surface of a substrate 2 (preferably with thick-film technology), for instance an $Al_2O_3$ substrate or some other ceramic substrate, are a series of layers. FIG. 1 A shows only the layers of importance for the invention. In addition to the illustrated layers, a series of further layers can be applied beneath, between or above the illustrated layers, for instance insulation, cover and protective layers and layers which influence the thermal dissipation. A first conductive layer 5 is firstly applied to the substrate 2 and structured, which layer includes, in addition to the terminal pads 6 and 7, a conductor 8 extending transversly to the longitudinal direction of the substrate 2. The conductor 8 is a portion of a U shaped conductor loop in the conductive layer 5. Applied above the conductive layer 5 is a resistive layer 9, which is so structured that an approximately rectangular region of the resistive layer connects the limbs of the U shaped conductor loop at its upper ends. That is to say, an electrical contact is produced between the conductive layer 5 and the resistive layer 9. In an alternative exemplary embodiment, the resistive layer 9 could also be arranged beneath the conductive layer 5. As a result of this arrangement of the structured resistive layer 9 and the structured conductive layer 5, a parallel circuit is produced between a resistor and a U shaped conductive loop, whereby one connection of the parallel circuit is connected directly to the contact pad 6.

Applied above the conductive layer 5 is an electrically insulating layer (not shown in FIG. 1A) and applied to this insulating layer is at least one further structured conductive layer 3. The further conductive layer 3 is so structured that it constitutes a conductive strip, which overlaps the contact surface 7 at its one end and overlaps the U shaped conductor at its other end. Formed in the two overlapping regions in the insulating layer arranged between the conductive layer 5 and the at least one further conductive layer 3 there is a window, so that contact can be produced between the conductive layer 5 and the conductive layer 3 at these positions. The contact of the conductive layer 3 with the conductive layer 5 disposed beneath it in the U shaped conductor region is located at that end of the U shaped conductor loop which constitute the node, which is not connected to the contact surface 6, of the parallel circuit of the conductive layer 9 and U shaped conductor loop. Furthermore, a section 4 of the at least one further conductive layer 3 crosses over the conductor 8. The section 4 of the conductive layer 3, which crosses over the conductor 8, is separated from the conductor 8 by the insulating layer. Furthermore, the section 4 of the at least one conductive layer 3 is constructed in the form of a fusible conductor element, for instance (as illustrated in FIG. 1A) of smaller breadth than the remainder of the conductor formed in the conductive layer 3. The section 4, constituting the fusible conductor element, in the at least one conductive layer 3 can, for instance, include a thick film conductor containing silver and, additionally, a solder layer applied onto it.

FIG. 1 B is a circuit diagram of the arrangement schematically illustrated in FIG. 1 A. The contact pads 6 and 7 correspond to the terminals 16 and 17, respectively. The U shaped conductor loop in the conductive layer 5 corresponds to the short circuit connection 18. The resistive element formed in the resistive layer 9 corresponds to the resistor R 19. The fusible conductor element formed in the at least one second conductive layer 3, in the section 4, corresponds to the fusible conductor element 14 in FIG. 1 B.

In normal operation, in which the currents flowing through the component 1 are sufficiently small that the fusible conductor element 14 remains intact, the current flows substantially via the short circuit connection 18 and the fusible conductor element 14 between the terminals 16 and 17. The component 1 has a low ohmic resistance.

When the current flow through the component 1 exceeds a predetermined current density for a predetermined period of time, the fusible conductor element 14, ie the section 4 in the conductive layer 3, ruptures. The process of rupturing (blowing) depends on the structure of the fusible conductor element. If, for instance, a conductive layer 3, containing silver particles, is covered at a predetermined position by a solder layer (which contains tin and lead) and if the flowing of the current effects heating of the component, the conductive layer is ruptured as a result of a complex process, which is accompanied by the melting of the solder metal, the diffusing of the metal into the silver layer, the increase of the specific resistance of the conductive layer and the local heating and the vaporisation of the conductive layer. In other cases, in which the fusible conductor element merely includes a conductive layer, the rupturing process is primarily determined by the vaporisation of the conductive layer material as a consequence of local heating. In any event, local rupturing of the conductive layer 3 occurs in the section 4, whereby an arc forms at the rupture point, with the aid of which a continuing current flow is rendered possible with the conductive pathway interrupted. The arc produces further vaporisation of the conductive layer regions, situated at the two ends of the arc, of the layer 3, whereby the remaining ends of the conductive layer, between which the arc has formed, become further spaced from one another, whereby the arc becomes longer.

Figure 1B:
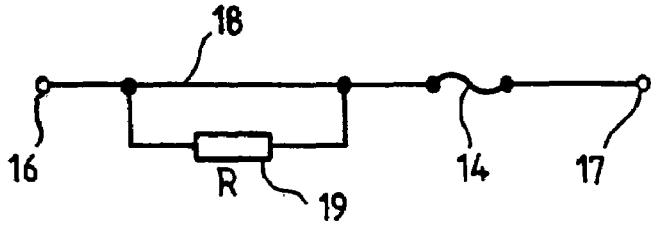
FIG. 1B is a circuit diagram of the fuse component shown in FIG. 1 A.
Figure 2A:
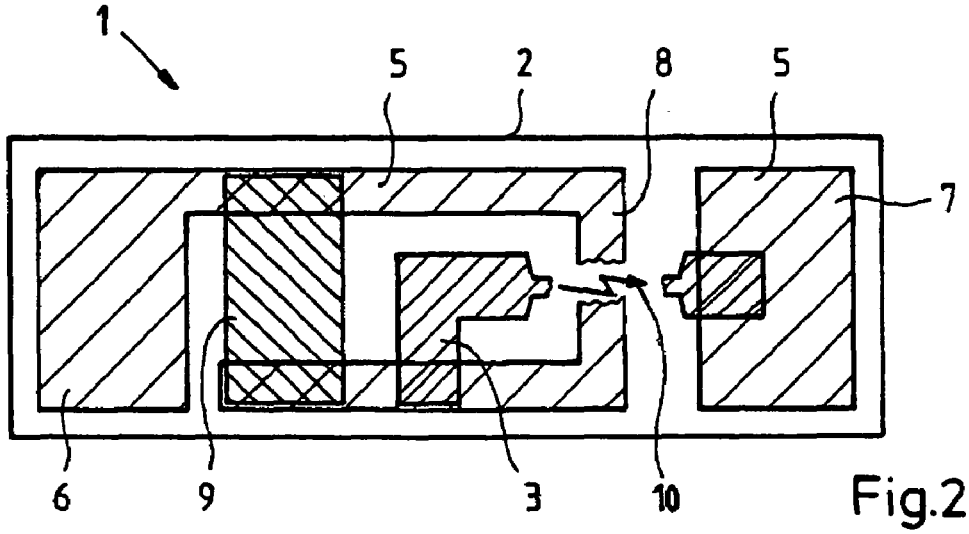
FIG. 2A is a schematic view of the important elements of the layout of the fuse component shown in FIG. 1A after the formation of an arc on rupturing of the fuse component.

The fuse component 1 and the circuit illustrated in FIG. 1B are shown schematically in FIGS. 2 A and 2*b*, respectively, in the event that an arc 10 has formed in the region of the ruptured section 4 of the conductive layer. Whilst the arc 10 vaporises the material of the section 4, the energy of the arc results at the same time in vaporisation of the material of the insulating layer situated beneath it and of a portion of the material of the conductive layer 5 in the conductor 8 situated beneath the insulating layer. As a result of the action of the arc 10, the conductor 8 is finally ruptured. The thickness of the insulating layer between the conductive layer 3 and the conductive layer 5 in the region of the conductor 8 should be so selected that it provides adequate electrical insulation on the one hand but on the other hand is as thin as possible in order to enable the action of as high a proportion as possible of the energy of the arc on the conductive layer 5 of the conductor 8. Furthermore, the combination of the conductive layer 5 (in the conductor region 8) and the insulating layer should be so constructed that striking of an arc between the section, connected to the connector 6, of the interrupted conductor 8 and the section, connected to the connector 7, of the conductive layer 3 is prevented. This can be achieved by a suitable design of the layout and insulating layer thickness.

Figure 2B:
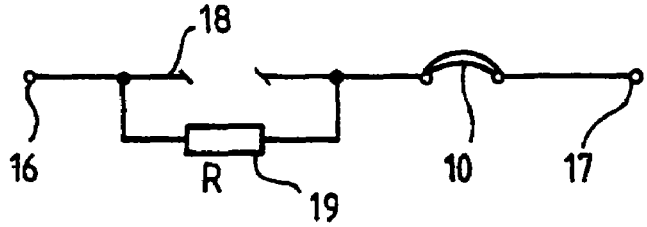
FIG. 2B is a basic circuit diagram of the fuse component shown in FIG. 2 A after formation of the arc.

FIG. 2B shows the circuit diagram, which is produced when the arc 10 has struck and the conductor 8 has already ruptured. The short circuit connection 18 connected in parallel with the resistor R 19 is ruptured so that the resistor R 19 is connected in series with the arc 10 between the terminals 16 and 17. The resistor R thus limits the current flowing via the arc 10. The dimensioning of the resistor 19, not only as regards the ohmic resistance R which is produced but also as regards the current absorbing ability (maximum dissipation loss) depends on a number of factors, which depend on the maximum voltage applied between the contacts 16 and 17 and the desired maximum current (short circuit current). In one embodiment R could have a resistance between 5Ω and 20Ω, for instance 10Ω.

Numerous alternative embodiments are possible within the scope of the inventive concept.

When using the component as a fuse component, the layout illustrated in FIG. 1 A could be considerable modified (with inherently the same circuit diagram). The sequence of the application of the layers could also be varied. For instance, the conductor 8 could be disposed parallel to the section 4 of the conductor 3 or cross the section 4 twice, in the event of a U shape of the conductor 8. In an alternative embodiment, the energy of the arc could also be used to modify a layer applied to the substrate 2, without vaporising it. For instance, the action of the arc could cause an increase in the layer resistance, for instance as a result of alloying effects.

The invention claim is:

1. A component with an internal conductor, which is so configured that it is ruptured at a predetermined position while forming an arc, if predetermined current/voltage conditions occur at terminals of the component, said component comprising a circuit element which is so arranged that an arc formed at the predetermined position can act on the circuit element such that the circuit element alters electrical properties of the circuit element, wherein the circuit element comprises a second conductor, which is ruptured under the action of the arc and wherein the second conductor crosses the internal conductor at the predetermined position and further comprising a resistive element in parallel with the second conductor on which the arc can act.

2. The component of claim 1, wherein the component is a layered component, the conductor and the circuit element including structured layers located on a substrate.

3. The component of claim 1, wherein the component includes two terminals, the internal conductor and the circuit element being connected between the two terminals.

4. The component of claim 3, wherein the circuit element comprises a second conductor, which is ruptured under the action of the arc.

5. The component of claim 1, wherein the circuit element comprises a two-pole component, which alters its electrical resistance under the action of the arc.

6. The component of claim 1, wherein the internal conductor, which is ruptured to form an arc, is connected in series with a parallel circuit comprising the circuit element and resistive element.

7. The component of claim 6 for use as a fuse component, wherein the internal conductor is ruptured to form an arc if a current through the conductor exceeds a maximum value for an associated maximum period of time.

8. The fuse component of claim 7, wherein the resistive element, which is connected in parallel with the second conductor, has a resistance between 5Ω and 20Ω.

9. The fuse component of claim 7, wherein the internal conductor includes a fusible conductor.

10. The fuse component of claim 8, wherein the internal conductor includes a fusible conductor.

11. The fuse component of claim 7, wherein the internal conductor and the second conductor and the resistive element comprise structured layers on a substrate, the internal conductor being arranged above a section of the second conductor and separated from it by an electrically insulating layer.

12. A fuse component, comprising:

an insulating substrate;

a conductive layer atop the substrate, the conductive layer including a transverse portion;

a resistive element atop the conductive substrate, the resistive element in contact with two ends of the conductive layer;

a fusible conductor in series with the resistive element, a path of the fusible conductor nearing a path of the conductive layer in the transverse portion, so that when an arc is formed near a location where the fusible conductor nears the conductive layer, the arc can act on the fusible conductor to alter electrical properties of the fusible conductor;

a first terminal connected with the conductive layer; and a second terminal connected to the fusible conductor.

13. The component according to claim 12, wherein the conductive layer is in a form of a U, the resistive element in contact with two ends of the U.

14. The component according to claim 12, wherein the resistive element has an electrical resistance between about 5Ω and about 20Ω.

15. The new component according to claim 12, wherein the path of the fusible conductor nears the path of the conductive layer in the transverse portion where the paths cross.

16. A fuse component, comprising:

an insulating substrate;

a conductive layer atop the substrate, the conductive layer including two ends and a middle portion;

a resistive layer atop the conductive substrate, the resistive layer in contact with two ends of the conductive layer;

a second conductor in series with the resistive layer, the second conductor crossing the conductive layer in the middle portion, so that when an arc is formed near a location where the second conductor crosses the conductive layer, the arc can act on the fusible conductor to alter electrical properties of the second conductor;

a first terminal connected with the conductive layer; and a second terminal connected to the second conductor.

17. The fuse component according to claim 16, wherein the second conductor is a fusible conductor.

18. The fuse component according to claim 16, for use as a fuse component, wherein the second conductor is ruptured to form an arc if a current through the second conductor exceeds a maximum value for an associated maximum period of time.

19. The fuse component according to claim 16, wherein the second conductor comprises a two-pole component, an electrical resistance of the component altered under the action of the arc.

* * * * *